US006397478B1

(12) United States Patent
Bornancini

(10) Patent No.: US 6,397,478 B1
(45) **Date of Patent: *Jun. 4, 2002**

(54) PLASTIC HANDLE FOR A CUTTING INSTRUMENT SUCH AS SCISSORS AND SCISSORS HAVING A PAIR OF SUCH HANDLES

(75) Inventor: José Carlos Mario Bornancini, Rio Grande do Sul (BR)

(73) Assignee: Zivi S.A. - Cutelaria, Porto Alegre (BR)

( * ) Notice: Subject to any disclaimer, the term of this patent is extended or adjusted under 35 U.S.C. 154(b) by 0 days.

This patent is subject to a terminal disclaimer.

(21) Appl. No.: 09/414,889

(22) Filed: Oct. 8, 1999

Related U.S. Application Data

(63) Continuation of application No. 08/211,545, filed on Apr. 7, 1994, now Pat. No. 6,000,138.

(30) Foreign Application Priority Data

Oct. 8, 1991 (BR) ..... MU 7102282
Oct. 7, 1992 (US) ..... PCT/BR92/00017

(51) Int. Cl.[7] ..... B26B 13/20
(52) U.S. Cl. ..... 30/232; 30/341
(58) Field of Search ..... 30/232, 254, 298, 30/260, 340, 526; 2/106.5; 606/174

(56) References Cited

U.S. PATENT DOCUMENTS

| | | | | |
|---|---|---|---|---|
| 1,357,200 A | | 10/1920 | Kiefer | |
| 3,974,563 A | | 8/1976 | Koch | |
| 4,091,539 A | * | 5/1978 | Watanabe | 30/341 |
| 4,663,848 A | | 5/1987 | Sell | |
| 4,715,122 A | | 12/1987 | Linden | 30/254 |
| 5,109,608 A | * | 5/1992 | Pracht | 30/232 |
| 6,000,138 A | | 12/1999 | Bornancini | |

FOREIGN PATENT DOCUMENTS

| | | |
|---|---|---|
| DE | 2811398 | 3/1979 |
| FR | 2515563 | 5/1983 |
| GB | 207968 | 1/1924 |
| GB | 2229128 | 9/1990 |

* cited by examiner

*Primary Examiner*—Douglas D Watts
(74) *Attorney, Agent, or Firm*—Smith, Gambrell & Russell, LLP

(57) ABSTRACT

Handles for cutting instruments such as scissors are described, each handle being made of a relatively rigid plastics material and being provided in its finger-receiving hole portion (8;8') with a lining ring (15;15') of elastically deformable material, such as natural or synthetic rubber. Such elastically deformable ring permits the scissors to adapt itself to the fingers of the user, independently of their size or whether the user is right- or left-handed.

12 Claims, 2 Drawing Sheets

PLASTIC HANDLE FOR A CUTTING INSTRUMENT SUCH AS SCISSORS AND SCISSORS HAVING A PAIR OF SUCH HANDLES

This application is a continuation of Ser. No. 08/211,545 filed Apr. 7, 1994, U.S. Pat. No. 6,000,138.

The present invention refers to plastic handles for cutting instruments such as scissors and to scissors using such handles.

It is known to manufacture scissors having steel blade members and plastic handles, for example from Brazilian patent 86447. It is also known, for example from Brazilian Utility Model patent 5500563 of Jun. 10, 1975 for dress makers scissors to have the plastic handles anatomically shaped to receive the user's fingers so as to maximise comfort and cutting control. Comfort in using the scissors depends not only on the shape but also on the extension of the surfaces of the finger-receiving holes that are contacted by the user's fingers since the sensation of effort in cutting is reduced as the area of finger contact is increased. For this reason and bearing in mind that it does not result in any appreciable increase in weight of the scissors, plastic handles may be made with shapes and sizes that are more comfortable to use and give the sensation of lightness in cutting even thick cloth.

It has been found, however, that perfect adaptability of the handles by varying their shapes and dimensions is not in practice possible due to the very variable characteristics of the hands of different individuals. An extreme example is the obvious difference between right-handed and left-handed persons.

The work "The Psychology of Everyday Things" by Donald A. Norman states: "In this case only special products help, such as scissors and knives for left-handed persons. But these special instruments sometimes do not work, for example when the same item has to be used by many different people. In such cases, the only solution is to make it ambidextrous, even if this makes it a little less efficient for each person in particular".

U.S. Pat. No. 4,091,539 to Tokuji Watanabe issued on May 30, 1978 discloses large size scissors without plastic handles but rather of a simple nature with each blade or cutting member formed with a finger-hanging hole portion by press moulding, such hole portion having then applied thereto an anatomically shaped plastic part. That patent shows how such specially shaped parts may be simply applied to the inner peripheries of the holes in the finger-hanging hole portions so as to provide inexpensive decorative large size scissors with inner protective rings in the finger holes. However, it is clearly shown that the scissors cannot be adapted for use by left-handed persons, such alternative scissors having a mirror image construction both as regards the cutting members and as regards the protective rings.

The solution of Watanabe, however, apart from not being applicable to scissors already manufactured with the larger more comfortable plastic handles, does not in any way solve the problems of variations in the characteristics of the hands of different right-handed or different left-handed people.

Other totally metallic scissors are known in which the finger holes are covered with rigid or soft plastic rings injected directly onto the metal parts or applied thereto mechanically. Examples are the products INCOLMA of Columbia (based on the product WOW ALEX of Japan), HUMMINGBIRD-PLUS of Japan, "PANDA" AMC of France, SHEFFIELD of the United Kingdom and H. W. B ÖKER of SOLINGEN (Germany).

Other types of scissors are known that plastic handles the "eyes" or finger holes of which are provided with hard plastic rings of different colours. Such an arrangement has a purely aesthetic purpose, an example being the product commercialised as BARRILITI by the company SOLINGEM of Germany.

Another inconvenience to be found in all known large size scissors having plastic handles and designed to be adapted specially to the hand (ergometrically designed scissors) is that, due to the bulkiness of the handles and the ergometrically formed portions of the finger holes, there is no well defined longitudinal plane of symmetry of each handle and, to the extent that such plane of symmetry could exist, it does not coincide with the cutting plane of the blade members. This makes cutting control difficult. An example can be found in the scissors commercialised by FISKARS.

A first object of the present invention is to provide a plastic handle for a cutting instrument such as scissors that automatically adjusts itself to the hand of the user, independently of the size of the hand or of whether he is right- or left-handed.

The present invention thus refers to a plastic handle for a cutting instrument such as scissors, comprising a shank portion having a first blade end adapted for receiving substantially longitudinally therein a handle end of a cutting member and a second finger-receiving end, and a finger-receiving portion in continuation to the second end of the shank portion and having an external peripheral surface and an internal peripheral surface, the internal peripheral surface defining a finger hole for receiving one or more fingers of the user.

According to the invention, such a plastic handle is characterised by further comprising an elastically deformable annular covering applied around the internal peripheral surface of the finger-receiving portion so as to provide the latter with ergometric characteristics adaptable to any finger, independently of the user being right- or left-handed.

It is particularly advantageous and possible in accordance with this invention for the plastic handle to have a longitudinal plane of symmetry.

Preferably, the elastically deformable annular covering comprises a separate part attached to said internal peripheral surface of the finger-receiving portion and, in a preferred embodiment, such annular covering or ring has an inner peripheral surface for finger contact and an outer peripheral surface shaped to cooperate in mutual connecting relationship with the shaped internal peripheral surface of the finger-receiving portion.

In such preferred embodiment, one of the above mentioned internal and outer shaped peripheral surfaces is shaped to form a continuous T-shaped rib, the other of such surfaces being shaped to define a corresponding cooperating continuous T-shaped channel.

In order to avoid discomfort due to contact between the user's finger and a relatively sharp edge of the internal peripheral surface of the finger-receiving portion, the inner peripheral surface of the ring is preferably rounded and wider than both of the internal and external peripheral surfaces of the finger-receiving portion.

The elastically deformable ergometric covering or ring permits the inner periphery of the finger-receiving portion of the handle to adapt itself to the shape and angle of the finger or fingers, providing a cushioning effect without, however, removing the firm sensation of the rigid plastic of the finger-receiving portion. Such elastically deformable covering or ring may comprise natural rubber or synthetic materials, such as thermoplastic rubbers, thermoplastic elastomers, thermoplastic polyester elastomers or thermoplastic polyurethane elastomers. The covering or ring may be the same colour as that of the rigid plastic of the main part of the handle or may be differently coloured so as to make it stand out and emphasise its special function.

The invention also relates to scissors of the type comprising first and second cutting members, each having a blade portion and a handle end portion, the cutting members being pivoted together to permit relative scissor movements thereof about a point between the blade portions and the handle end portions. According to the invention, scissors of this type are provided with first and second plastic handles respectively mounted on the handle end portions, each handle being as defined above and having the mentioned elastically deformable annular covering around the finger holes.

As will be better understood from the following specific description to be made with reference to the accompanying drawings, a cutting instrument or scissors incorporating the above characteristics has the following desirable characteristics:

- the elastically deformable rings provide the instrument with an automatic adaptability to the shapes and dimensions of the fingers of the specific user as opposed to what happens with known "ergometrically designed" scissors which provide substantially fixed finger-receiving shapes to which the fingers of the user are expected to adapt themselves;
- the elastically deformable rings reduce the feeling of effort in cutting since finger pressure is applied to a deformable surface;
- abrasion of the skin due to direct contact between the user's fingers and the surface of the hard plastic, particularly because of the mould lines and any consequent moulding burrs, is avoided; and
- firmer and more controlled handling of the instrument due to the anti-slip properties of the elastic rings in the finger holes as well as to the fact that the handles have planes of symmetry coincident with the cutting plane of the cutting blades or members.

The present invention will be better understood from the following specific description of presently preferred embodiments thereof, given by way of example and with reference being made to the accompanying drawings, in which FIG. 1 is a front plan view of preferred scissors embodying the present invention;

Figure 1:
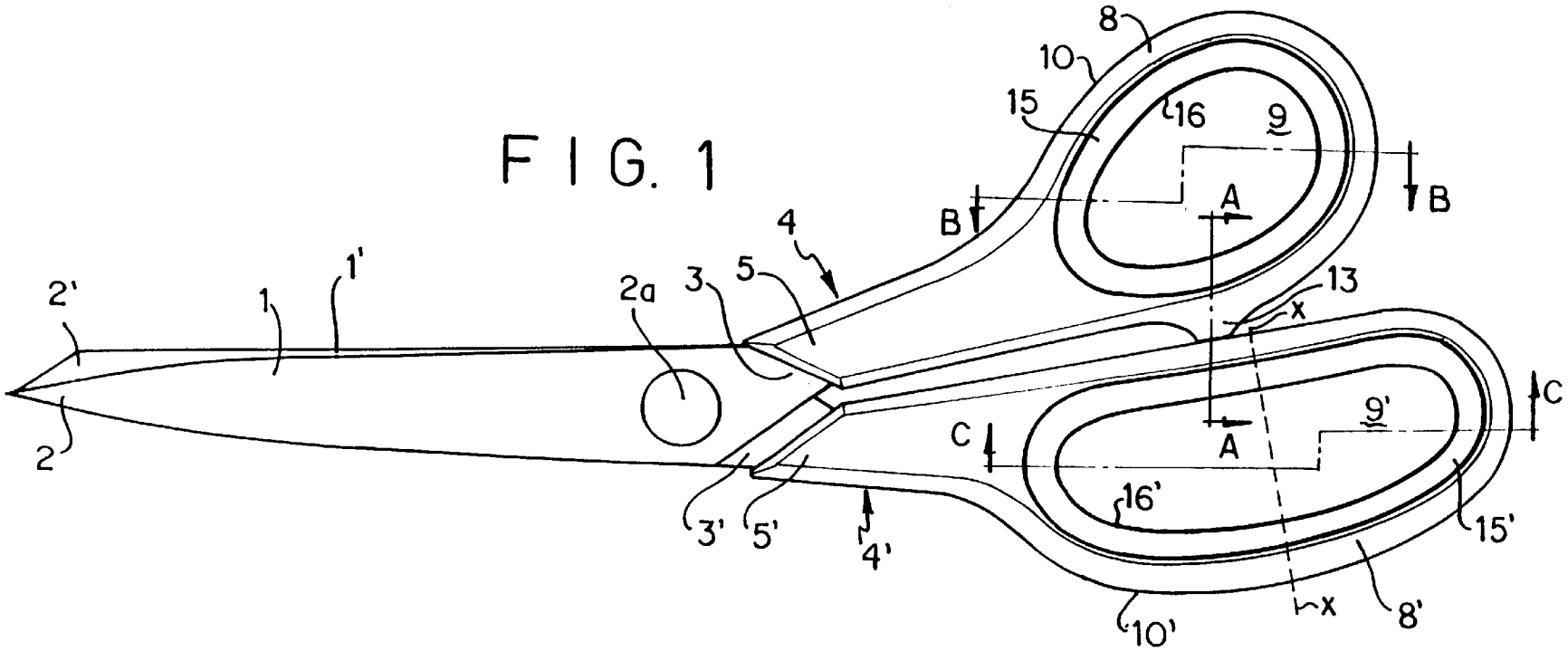
Figure 5:
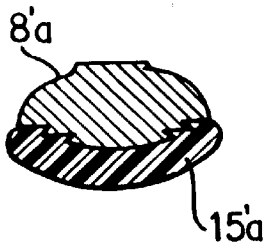
Figure 4:
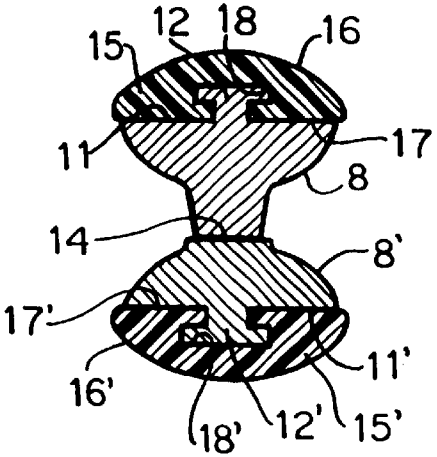

FIG. 4 is a section along line A–A' of FIG. 1, showing the mutual support zone of the finger-receiving portions of the handles; and FIG. 5 is a cross section of the lower finger-receiving portion of the handle, substantially along a line corresponding to A–A" of FIG. 1, but of a second preferred embodiment in which the ring of elastically deformable material, instead of being manufactured as a separate part, is injection moulded directly onto the rigid plastic of its respective handle.

Referring now to FIGS. 1 to 4 of the drawings, scissors constructed according to a first preferred embodiment of the present invention comprise first and second steel blade or cutting members 1 and 1' having respective blade ends 2 and 2' and respective handle ends 3 and 3'. The cutting members 1 and 1' are pivoted together by means of a pivot pin 2*a* between the blade ends 2 and 2' and the handle ends 3 and 3'.

Upper and lower handles 4 and 4' moulded from a rigid plastics material have respective shank portions 5 and 5', each having a first blade end into which a respective handle end 3 or 3' is received and anchored substantially longitudinally and a second finger-receiving end which continues as a finger-receiving portion 8 or 8' defining a respective finger-receiving eye 9 or 9.'

Each finger-receiving portion 8 or 8' has a generally rounded external peripheral surface 10 or 10' and an generally planar internal peripheral surface 11 or 11'. The internal peripheral surfaces 11 and 11', however, are formed with continuous central T-shaped ribs 12 and 12' for a purpose that will become apparent in the following description.

The inner profiles of the finger-receiving portions 8 and 8' of handles 4 and 4', as determined by the internal peripheral surfaces 11 and 11', are specifically designed to guarantee the ambidextrous nature of the scissors. Thus finger-receiving portion 8 defines a finger-receiving hole 9 of a generally oval shape having a smaller radius of curvature towards the blade or cutting members and a larger radius of curvature at its other free end.

The other finger-receiving portion 8', on the other hand defines a longer finger-receiving hole 9' which is composed of four curves, those at the cutting member and free ends being identical and connected to each other by an outer slightly convex curve and an inner slightly concave curve. As can be clearly seen from FIG. 1, the result is a finger-receiving hole 9' that is symmetrical about a transverse line X.

Although the specific shapes of the finger receiving holes 9 and 9' are not essential features of the present invention, those illustrated and particularly that of the thumb hole 9 result from considerable research and development of prototypes to determine the most suitable angles and curvatures. The shape of finger-receiving hole 9' also has to take into account the fact that, in the case of large size scissors, although most people like to insert three fingers, others insert four. The use of the elastically deformable rings 15' to be described below assist in making this possible without prejudice to the perfect adaptability of the handles to the individual user.

It should also be noted that the longitudinal plane of symmetry of the handles (i.e. that passes through the axes of symmetry of the T-shaped ribs 12 and 12') coincides with the cutting plane of the blades or cutting members 1 and 1'. This permits better cutting control during use.

As is known, the lower external side of finger-receiving portion 8 of the upper handle of the scissors is formed with a protuberance 13 that abuts a flat surface 14 of the corresponding upper side of portion 8' of the other handle.

The internal peripheral surface 11 or 11' of each finger-receiving portion 8 or 8' has applied thereto, over its T-shaped rib 12 or 12', a ring of elastically deformable material 15 or 15' having a generally rounded inner peripheral surface 16 or 16' for finger contact and a generally planar outer peripheral surface 17 or 17' formed with a central continuous T-shaped groove 18 or 18' that mates tightly with the rib 12 or 12' so as to anchor the ring 15 or 15' in place with surfaces 11, 12 or 11', 12' in intimate contact. It will be understood that the ribs 12 and 12' fitted into grooves or channels 18 and 18' not only serve to anchor the deformable rings in place, but also provide them with a certain rigidity in the cross direction so that the finger-receiving holes are stable and not easily deformable transversely. Moreover, they add to the general rigidity of the handles 4 and 4'.

As mentioned above, the rings 15 and 15' may be made of any suitable materially that is elastically deformable when under finger pressure but which regains its original shape when the pressure is removed. Rubber type materials would normally be used, mention already having been made of thermoplastic rubbers, thermoplastic elastomers, thermoplastic polyester elastomers or thermoplastic polyurethane elastomers.

Figure 2:
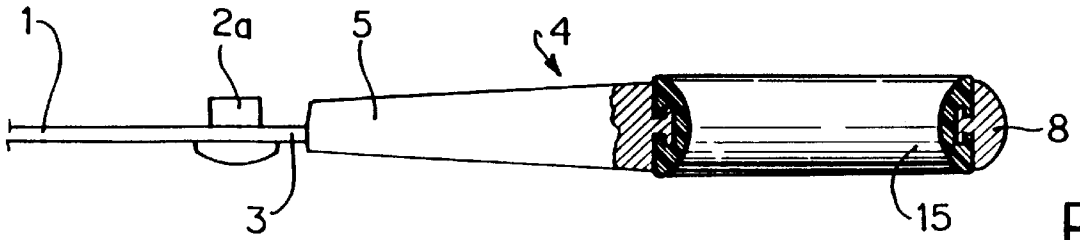
FIG. 2 is a partial top view showing the upper handle of the same scissors, and part of only the outer blade or cutting member, with the upper finger-receiving portion sectioned along line B–B' of FIG. 1.
Figure 3:
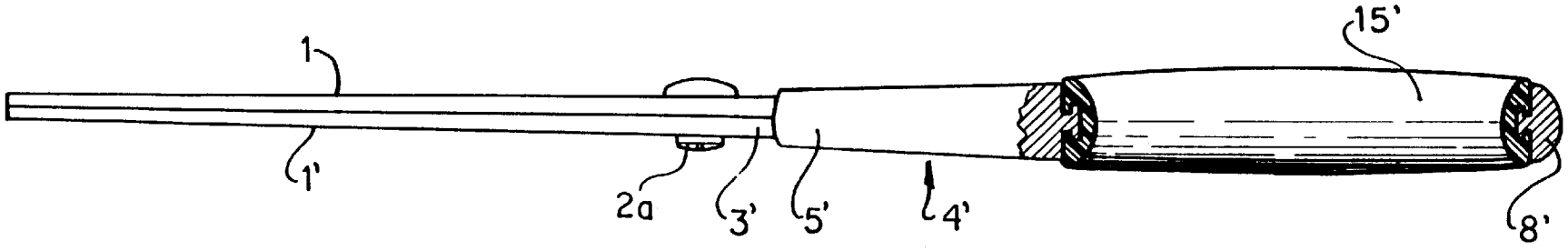
FIG. 3 is a partial bottom view showing the same scissors with the lower finger-receiving portion sectioned along line C–C' of FIG. 1 corresponding to the inner blade or cutting member.

Finally, with respect to the embodiment illustrated in FIGS. 1 to 4, it will be seen from FIGS. 2, 3 and 4 that the inner peripheral surfaces 16 and 16' of rings 15 and 15' are slightly wider than the external peripheral surfaces 10 and 10' of the finger-receiving portions 8 and 8'. This is to ensure that there is no sharp edge of the harder rigid plastic of handles 4 and 4' that will be contacted by the fingers of the user, the softer deformable material of rings 15 and 15' serving to protect the user.

It is presently preferred to mould the rigid plastic parts of the handles 4 and 4' separately from the deformable rings 15 and 15' and then later to assemble them. This not only permits substitution of the "ergometric" rings but also permits the handles and rings to be made in various different colours that may be combined at will. In spite of the fact that it does not enjoy such advantage, a second preferred embodiment illustrated in FIG. 5 simplifies manufacture. In the case of FIG. 5, which shows a section through a handle corresponding to handle 4' of FIGS. 1 to 4 at a position corresponding to line A–A' of FIG. 1, the outer peripheral surface of an elastically deformable ring 15'*a* and the corresponding internal peripheral surface of a corresponding finger-receiving portion 8'*a* are formed with discontinuities that produce a jagged appearance in section so as to permit the ring to be injected directly onto the finger-receiving portion. Other methods of permanent, automatic or manual manners of fixing the elastically deformable rings to the handles of the scissors will certainly be obvious to a person versed in the art and are intended to be embraced by the concept of the present invention.

Although the embodiments described and illustrated herein relate to scissors the finger-receiving holes of which are lined with rings of elastically deformable material, it will be understood that a similar effects could be achieved if such hole were to be only partially lined, that is to say, if the rings were to be replaced by coverings that do not pass completely around the finger holes, but rather at least along all perts of the peripheries thereof that will contact the fingers of the user. Modifications of this nature will also be evident ot a person skilled in the art and are intended to be within the scope of this invention. Without doubt there are also are other variants that do not diverge from the inventive concept and are therefore intended to be embraced by the scope of the invention.

What is claimed is:

1. Plastic handle for ambidextrous use of a cutting instrument such as scissors, comprising a shank portion having a first blade end adapted for receiving substantially longitudinally therein a handle end of a cutting member and a second finger receiving end, and a finger-receiving portion in continuation to said second end having an external peripheral surface and an internal peripheral surface, said internal peripheral surface defining a hole for receiving one or more fingers of the user, characterized by further comprising an elastically deformable annular covering applied around said internal peripheral surface of the said finger-receiving portion, said covering being sufficiently elastically deformable under finger pressure to adapt the scissors to use by both left-handed and right-handed users, said covering being a separate ring of elastically deformable material attached to said internal peripheral surface of the finger-receiving portion, said ring having an inner peripheral surface for finger contact and an outer peripheral surface shaped to co-operate in mutual connecting relationship with said internal peripheral surface of the finger-receiving portion, one of said internal and outer peripheral surfaces having at least one projection, the other of said internal and outer peripheral surfaces being shaped to co-operate in mutual connecting relationship with said projection so as to anchor the ring in place.

2. Plastic handle according to claim 1, having a longitudinal plane of symmetry coincident with the plane of said hole.

3. Plastic handle according to claim 1 in which a cross section of said annular covering is convex at the inner peripheral surface on the annular covering, said cross section being wider than that of both said external and said internal surfaces of the finger-receiving portion.

4. Plastic handle according to claim 2, in which a cross section of said annular covering is convex at the inner peripheral surface on the annular covering, said cross section being wider than that of both said external and said internal surfaces of the finger-receiving portion.

5. Scissors for ambidextrous use, comprising:

first and second cutting members, each said cutting member having a blade portion and a handle end portion and said first and second cutting members being pivoted together to permit relative scissor movements thereof about a point between said blade portions and said handle end portions, first and second plastic handles respectively mounted on said handle end portions of said first and second cutting members, each of said handles having a shank portion having a first blade end mounted on the handle end portion of a corresponding one of said first and second cutting members and a second finger-receiving end, and a finger-receiving portion in continuation to said second end, having an external peripheral surface and an internal peripheral surface, said internal peripheral surface defining a hole for receiving one or more fingers of a user; and first and second elastically deformable annular coverings respectively applied around said internal peripheral surfaces of the said finger-receiving portions, said coverings being sufficiently elastically deformable under finger pressure to adapt the scissors to use by both left-handed and right-handed users, each said covering comprising a separate ring of elastically deformable material attached to said internal peripheral surface of the corresponding finger-receiving portion, said ring having an inner peripheral surface for finger contact and an outer peripheral surface shaped to co-operate in mutual connecting relationship with said internal peripheral surface of its corresponding finger-receiving portion, one of said internal and outer peripheral surfaces of each said finger-receiving portion and the corresponding ring having at least one projection, the other of said internal and outer peripheral surfaces being shaped to co-operate in mutual connecting relationship with said projection so as to anchor the ring in place.

6. Scissors according to claim 5, in which said handles have a common longitudinal plane of symmetry that coincides with a cutting plane of said cutting members.

7. Scissors according to claim 5, in which a cross section of each said annular covering is convex at the inner peripheral surface of the corresponding said annular covering, said cross section being wider than that of both said external and internal surfaces of the corresponding finger-receiving portion.

8. Scissors according to claim 6, in which a cross section of each said annular covering is convex at the inner peripheral surface of the corresponding said annular covering, said cross section being wider than that of both said external and internal surfaces of the corresponding finger-receiving portion.

9. Plastic handle as recited in claim 1 wherein said annular covering is a one-piece ring of elastically deformable material.

10. Plastic handle as recited in claim 1 wherein said annular covering is a one-piece ring of elastically deformable material with the outer peripheral surface of said annular covering including an annular groove which receives therein a plastic projection of the internal peripheral surface of said finger-receiving portion.

11. Plastic handle as recited in claim 1 wherein said annular covering is a one piece ring of elastically deformable material having an elastically deformable projection at the outer peripheral portion of said annular covering which elastically deformable projection is received by a shaped plastic receiving portion at the internal peripheral surface of said finger-receiving portion.

12. Scissors according to claim 5 wherein each of said first and second annular coverings is a one-piece ring of elastically deformable material.

* * * * *